US007661511B2

(12) United States Patent
Hasegawa et al.

(10) Patent No.: US 7,661,511 B2
(45) Date of Patent: Feb. 16, 2010

(54) BOARD BUILDING MATERIAL, BOARD BUILDING MATERIAL PRODUCING METHOD, BOARD BUILDING MATERIAL INSTALLATION METHOD

(75) Inventors: Tomoya Hasegawa, Tokyo (JP); Yasuyuki Amagai, Tokyo (JP); Shoichi Okazaki, Tokyo (JP); Masahiro Wada, Tokyo (JP)

(73) Assignee: Yoshino Gypsum Co., Ltd., Tokyo (JP)

( * ) Notice: Subject to any disclaimer, the term of this patent is extended or adjusted under 35 U.S.C. 154(b) by 299 days.

(21) Appl. No.: 11/587,999

(22) PCT Filed: Apr. 27, 2005

(86) PCT No.: PCT/JP2005/008463

§ 371 (c)(1),
(2), (4) Date: Oct. 30, 2006

(87) PCT Pub. No.: WO2005/106156

PCT Pub. Date: Nov. 10, 2005

(65) Prior Publication Data

US 2007/0220824 A1 Sep. 27, 2007

(30) Foreign Application Priority Data

Apr. 28, 2004 (JP) ..... 2004-132587
Dec. 17, 2004 (JP) ..... 2004-366580

(51) Int. Cl.
*E04B 1/38* (2006.01)
*E04B 1/82* (2006.01)
*E04B 1/343* (2006.01)
*E04B 2/00* (2006.01)

(52) U.S. Cl. ..... 181/293; 181/287; 52/144; 52/145; 52/506.05; 52/712

(58) Field of Classification Search ..... 181/287, 181/293; 52/506.05, 144, 712, 145
See application file for complete search history.

(56) References Cited

U.S. PATENT DOCUMENTS 2,075,773 A * 3/1937 Vass ..... 52/592.1
2,087,867 A * 7/1937 Balduf ..... 52/349
2,110,080 A * 3/1938 Coddington ..... 366/114

(Continued)

FOREIGN PATENT DOCUMENTS

WO WO 2005/106156 A1 11/2005

*Primary Examiner*—Jeffrey Donels
*Assistant Examiner*—Christina Russell
(74) *Attorney, Agent, or Firm*—Jacobson Holman PLLC

(57) ABSTRACT

Perforations of a board for building material are formed by a number of recesses (13), or a number of recesses (13) and through-holes (12). A bottom face (16) of the recess forms a face for screwing or driving the fixing element (70) thereto. A color of the bottom face is set to have a brightness of color decreased in comparison with a color of a surface (18) of the board. A substrate of the board is a gypsum board and the bottom face of the recess is formed by a liner paper for gypsum board. According to such a board, a region for screwing or driving the fixing element thereto can be ensured without impairing regularity, uniformity or architectural design of the perforations, and putty finishing or the like for an exposed part of the fixing element can be omitted.

16 Claims, 15 Drawing Sheets

U.S. PATENT DOCUMENTS

| | | | | | |
|---|---|---|---|---|---|
| 2,114,386 | A | * | 4/1938 | Killion | 52/601 |
| 2,280,631 | A | * | 4/1942 | Coffey | 181/293 |
| 2,706,315 | A | * | 4/1955 | Price | 52/364 |
| 2,838,806 | A | * | 6/1958 | Sabine | 52/145 |
| 2,924,856 | A | * | 2/1960 | Price | 52/144 |
| 3,144,733 | A | * | 8/1964 | Balinski | 52/714 |
| 3,328,932 | A | * | 7/1967 | Cheskin | 52/323 |
| 3,445,975 | A | * | 5/1969 | Nelsson | 52/346 |
| 4,040,213 | A | * | 8/1977 | Capaul | 52/145 |
| 4,507,901 | A | * | 4/1985 | Carroll | 52/302.3 |
| 4,835,034 | A | * | 5/1989 | Cruz | 428/131 |
| 5,104,715 | A | * | 4/1992 | Cruz | 428/131 |
| 5,749,187 | A | * | 5/1998 | Umehara et al. | 52/241 |
| 6,036,149 | A | * | 3/2000 | Del Pino et al. | 248/231.91 |
| 6,334,280 | B1 | * | 1/2002 | Frappart et al. | 52/144 |
| 2005/0211500 | A1 | * | 9/2005 | Wendt et al. | 181/295 |
| 2007/0102237 | A1 | * | 5/2007 | Baig | 181/290 |
| 2007/0220824 | A1 | | 9/2007 | Hasegawa et al. | |
| 2007/0245679 | A1 | * | 10/2007 | Conville | 52/712 |

* cited by examiner (A)

(B)

(A)

(B)

(A)

(B)

BOARD BUILDING MATERIAL, BOARD BUILDING MATERIAL PRODUCING METHOD, BOARD BUILDING MATERIAL INSTALLATION METHOD

This is a nationalization of PCT/JP05/008463 filed Apr. 27, 2005 and published in Japanese.

TECHNICAL FIELD

The present invention relates to a board for building material, a method of producing the board and a method of installing the board, and more specifically, to such a board which has a number of perforations formed on its surface visually in a uniform and regular arrangement, a method of producing such a board, and a method of installing such a board.

TECHNICAL BACKGROUND

Boards for building material, such as gypsum boards and calcium silicate boards, are practically and widely used as architectural interior finish materials. In general, these kinds of boards are secured to interior finish base materials to be finished, such as light-weight steel base members or base boards, with use of fixing elements such as screws or nails (referred to as "fixing elements" hereinafter), or with use of adhesives and the fixing elements. The fixing elements are screwed or driven to the board so that exposed parts of the fixing elements are flush with surfaces or slightly sunk below the surfaces, whereby the fixing elements are tightly fixed to the base materials. On the surfaces of the boards, there are irregularities or dents locally formed around the exposed parts of the screwed or driven fixing elements, or cross recesses of the screw heads or the like for engagement with a rotating tool such as a screwdriver. Therefore, putty finishing is carried out for such exposed parts, before painting, wallpapering and so forth.

A construction method in consideration of such putty finishing can be assumed, wherein recesses, grooves or the like for the putty are preformed in screwing or driving positions of the fixing elements. For instance, circular recesses having a diameter slightly larger than that of a profile of the screw head are preformed in the screwing positions, and the putty is filled thereinto after the screws are driven to centers of the recesses, whereby the screw heads in the recesses are embedded in the putty. As a technique similar to this method, it is disclosed in Japanese patent application laid-open publication No. 55-138556 (JP No. 55-138556) that a board for building material has regular grooves corresponding to tile joints and exhibits a tile joint pattern. This board is secured to a base material by hammering nails into the bottom of the groove. The groove is filled with white cement. Heads of the nails are embedded in the solidified white cement, so that the heads are visually concealed from an interior space of a room.

Further, a board for building material preliminarily provided with an interior finish material on its surface, such as a decorated gypsum board or decorated calcium silicate board, is known. As regards this kind of board, it is unnecessary to execute painting, wallpapering or the like for the surface of the board. Therefore, an interior finish surface can be formed in an interior side by merely fixing the board to a ceiling or a wall. When such a decorated board is secured to a base material by screws, a measure is normally taken for irregularities or unevenness of the surface of the board caused by screw heads, exposure of the screw heads, or the like. For example, putty finishing for the screw heads or a specific painting for the screw heads is carried out, or specific screws are used.

A method for allowing the screw heads to be visually inconspicuous without such a treatment for the screw heads is disclosed in Japanese patent application laid-open publication No. 2003-154514 (JP No. 2003-154514), in which an irregular pattern is preformed on a surface of the board. This kind of method might be able to be used for a decorated ceiling board or the like having an irregular pattern, such as a vermicular pattern. However, such a method cannot be employed with respect to a board for building material having a uniform and regular formation of patterns, undulations or apertures.

Furthermore, a perforated board for building material having many through-holes of a small diameter or small dimensions is known. The perforated board is mainly intended for prevention of an echo, or control of a sound absorption performance or an acoustic reverberation time. The perforated board is a plate-like member having an appropriate open area ratio. In general, a layer of air, or a layer packed with a sound absorbing material such as a glass wool is provided behind the plate-like member; or otherwise, a sheet such as a sheet of paper is overlaid on a reverse face of the plate-like member. If required, an interior finish work such as painting or wallpapering is provided in a plant or a construction site with respect to a face of the perforated board on its interior side. It is disclosed in Japanese patent application laid-open publication No. 2000-504797 (JP No. 2000-504797, which corresponds to PCT pamphlet of PCT international application No. WO97/29254, that a part of through-holes of such a perforated board is formed to be fissure-like perforations which do not extend through the board.

In general, a number of through-holes are disposed in the perforated board mainly intended for acoustic control or sound absorption, and the through-holes exhibit a variety of patterns or shadows over the whole surface. However, the fixing element such as a board fixing screw cannot be driven or screwed in the through-hole. Usually, the perforated board is partially provided with non-perforated zones to which the fixing elements can be driven or screwed. For example, this kind of non-perforated zone is formed in a periphery of the board, or it is provided in a form of zone traversing the board.

However, if such a non-perforated zone is formed on the board, the number of through-holes and the locations of through-holes, or their regularity, uniformity and architectural design are restricted by forming the non-perforated zones. In addition, putty finishing and/or painting for concealing an exposed part of the fixing element has to be executed.

For architectural appearance of the exposed part of the fixing element, it might be possible to employ the method of preforming recesses, grooves or the like for putty finishing, as disclosed in JP 55-138556 as set forth above. According to such a method, however, drying shrinkage of the putty, aged deterioration of the putty and so forth may occur, which result in a condition that the recesses or grooves themselves are conspicuous.

On the other hand, the method of preforming irregular patterns on the board as disclosed in JP Nos. 2003-154514 and 2000-504797 as set forth above (i.e., method for allowing existence of the fixing element to be inconspicuous by irregular pattern or the like) cannot be employed for a perforated board having a regular or uniform thorough-holes.

Further, since the perforated board is mainly used for improving an acoustic performance of a room, it is desired in many cases that a certain area is entirely finished by the perforated boards. However, in some cases, it is not desired that the whole finished area has the sound absorption performance, owing to a purpose or structure of the room. For example, in some cases, it is desired that the perforated board is located only in a part effective in improvement of the acoustic performance, and that non-perforated boards are located in a part in which the sound absorption effect is unnecessary or in which an acoustic reflection is required. However, impairment of uniformity or unity of architectural design results from mixed use of the perforated boards and the non-perforated boards. This may lead to an unnatural impression or a sense of incompatibility, which often results in difficulty of interior design. Therefore, in practice, the finished area, such as a ceiling, is entirely finished by the perforated boards, regardless of whether the sound absorption performance is required.

It is an object of the present invention to provide a board for building material and a method of producing the board, which can ensure a region for screwing or driving a fixing element without impairing the regularity, uniformity or architectural design of the perforations, and which can improve workability of construction by omitting putty finishing or the like for an exposed part of the fixing element.

It is another object of the present invention to provide a construction method or execution method of the board for building, which enables arbitrary setting of a sound absorption effect and an acoustic reverberation effect of an interior finish surface, without impairing uniformity or unity of architectural design of the interior finish surface.

DISCLOSURE OF THE INVENTION

To attain the aforementioned object, the present invention provides a board for building material which has perforations disposed on a surface of the board, the perforations being constituted from a number of recesses, or a number of recesses and through-holes, wherein all or a part of the recesses are positioned in an area of the board in which fixing elements are to be screwed or driven, and wherein a bottom face of the recess constitutes a face for screwing or driving the fixing element thereto, and a color of the bottom face is set to have a brightness of color decreased in comparison with a color of the surface of the board.

According to the present invention, the recesses are disposed in the region for securing the board to a base material by means of the fixing element, whereby the board can be formed with portions (the recesses) secured by the fixing element. The color of the bottom face of the recess is set to have the brightness of color decreased in comparison with the color of the surface of the board. It is difficult to visually distinguish the recess from the through-hole, as viewed from the interior of the room, and therefore, the recess and the through-hole give a resident or the like a visually equal impression. That is, the portions for screwing or driving the fixing elements are formed by the recesses which are visually recognized as the through-holes, and therefore, regularity, uniformity or architectural design of the perforations is not restricted by provision of the screwing or driving regions.

The present invention also provides a board for building material which has perforations disposed on a surface of the board, the perforations being constituted from a number of recesses, or a number of recesses and through-holes, wherein the perforations are regularly or uniformly disposed on the surface of the board and wherein a color of a bottom face of the recess is set to have a brightness of color decreased in comparison with a color of the surface of the board.

According to such an arrangement of the present invention, it is difficult to visually distinguish the recess from the through-hole, as viewed from an interior of a room, and therefore, the recess and the through-hole gives a visually equal impression to a resident or the like. The regularity, uniformity or architectural design of the perforations is not restricted by forming the recesses (or it is not restricted by replacing a part or all of the through-holes with the recesses). Further, an exposed part of the fixing element can be positioned on the bottom face, which is set to have the decreased brightness of color in comparison with the color of the surface of the board and dented from the surface of the board. It is difficult for the resident to be visually conscious of such an exposed part of the fixing element. Therefore, it is possible to omit the putty finishing or the like for the exposed part of the fixing element.

Thus, according to the board of the present invention, the region for screwing or driving the fixing element can be ensured without impairment of the regularity, uniformity or architectural design of the perforations, and workability can be improved by omission of putty finishing or the like for the exposed part of the fixing element, or omission of painting, wallpapering or the like for the surface of the board.

If desired, the fixing element is provided with the exposed part having substantially the same color as that of the bottom face, or the exposed part is coated with a paint having substantially the same color as that of the bottom face. Preferably, the surface of the exposed part is formed with minute undulations or indentations for diffusely reflecting light. For example, the exposed part formed with such minute undulations or indentations is coated with a paint having substantially the same color as that of the bottom face. Alternatively, a relatively thick coat of paint is applied to the exposed part so that minute undulations or indentations are formed thereon by the coat. According to these arrangements, the exposed part is prevented form being visually conspicuous by natural or artificial light entering the recess in a certain direction. In other words, the exposed part can be further inconspicuous by such simple means, and this allows the resident or the like to be entirely unaware of the fixing element.

Preferably, the aforementioned recesses are disposed in the area of the board to which the fixing element should be screwed or driven, and the bottom face of the recess forms a face for screwing or driving the fixing element thereto.

Further, the present invention provides a board for building material having the aforementioned arrangement, wherein a sound absorption of the board is established by control of a ratio of the recesses and the through-holes.

Such an arrangement of the present invention enables arbitrary setting of the sound absorption effect and the acoustic reverberation effect of the interior finish surface of the board. That is, the through-hole increases the sound absorption performance of the board whereas the recess decreases the sound absorption performance thereof. Therefore, arbitrary setting of the sound absorption performance of the board can be carried out by control of the ratio of the recesses and the through-holes. In addition, change of the ratio of the recesses and the through-holes does not impair the regularity, uniformity or architectural design of the perforations. Such a control of the ratio may be performed by setting of an opening area ratio or setting of a quantity ratio of the recesses and the through-holes.

All of the perforations of the board can be formed by the recesses in accordance with the present invention. Such a board can be used as an acoustically non-absorptive perforated board, differently from the acoustically absorptive perforated board with the perforations of the through-holes. The acoustically non-absorptive perforated board gives the resident and so forth an impression visually equivalent to that of the acoustically absorptive perforated board. The viewer does not have a sense of incongruity even if the non-absorptive board is provided adjacent to the absorptive board on a finished surface. That is, in the eyes of the resident, the non-absorptive board is indistinguishable from the adjacent absorptive board. Therefore, it is possible to provide the absorptive board in only a part of the finished area, without impairing uniformity or unity of architectural design of the interior finish surface.

Further, the layout of the recesses on the acoustically absorptive board is preferably set to be in accord with the distance between base members (ceiling joists or the like) spaced at regular intervals. On the other hand, in an actual construction site, it is necessary to cut the boards into pieces for dimensional adjustment in a peripheral zone near the wall; or it is necessary to provide openings and their reinforcement structures for building equipment, such as air outlets, air-conditioners or lighting fixtures. The board with only the perforations of the aforementioned recesses (i.e., the acoustically non-absorptive board) can be preferably disposed in such a part. For example, in a case where the ceiling is generally constructed by the boards with the recesses only in positions for the fixing elements and the through-holes in the other area (i.e., the acoustically absorptive boards), the non-absorptive boards can be exceptionally secured only to a peripheral zone near the wall and a part surrounding the openings for building equipment. Even if the non-absorptive boards are provided in such a manner, uniformity or unity of architectural design of the ceiling surface is not impaired, and advantage of workability, such as omission of putty finishing or the like, can be still obtained.

From another aspect, the present invention provides a method of producing the aforementioned perforated board, wherein a flat pressing face of a male die is pressed against a surface of a board for building material so that a recess having a predetermined depth is formed thereon and a bottom face of the recess is formed for screwing or driving a fixing element thereto.

According to such a method, the board of the present invention can be efficiently produced.

It is preferred that a guide plate with a guide hole and an abutment face is used. The male die can be inserted into the guide hole and the abutment face can abut against the surface of the board. The pressing face of the male die is pressed against the surface of the board in a state that the abutment face is in contact with the surface of the board.

More preferably, there is provided a penetrating member, which has a profile substantially conforming to an outline of the recess and which transitionally penetrates the surface of the board for facilitating deformation of the surface. A projection, blade or scoring member can be preferably used as such a penetrating member. The penetrating member forms bending means, such as a groove, a V-shaped cut, a folding line or dots, on the surface of the board.

From still another aspect, the present invention provides a method of installing the board for building material, comprising a step of; installing on an interior surface, the first board which is improved in its sound absorption performance by controlling a ratio of the recess and the through-hole as set forth above, and the second board which is reduced in its sound absorption performance by controlling the ratio of the recess and the through-hole, thereby setting a sound absorption effect and an acoustic reverberation effect of a room.

According to such a method, it is possible to arbitrarily set the sound absorption effect and the acoustic reverberation effect of the interior finish surface, without impairing uniformity or unity of architectural design of the interior finish surface.

The board (second board) reduced in its sound absorption performance includes a board which does not have any through-hole but has only the recesses.

In a preferred embodiment of the present invention, the bottom face has an index for positioning a tip of the fixing element. Such an index is used as a mark for allowing the worker to recognize the position for securing the board. Preferably, this positioning index is made by print, application of paint, denting or the like. It is preferred that the index is a dent or aperture positioned at a center of the bottom face of the recess, into which the tip of the fixing element can be inserted. According to such an arrangement, the fixing element can be centered in the recess by the index and the fixing element can be accurately screwed or driven into the board by guidance of the index.

In an embodiment of the present invention, a number of perforations uniform in size and shape are formed on the surface of the board by the through-holes and the recesses. In another embodiment, the dimensions of the through-hole and the recesses are set to be in accord with a pattern of the perforations on the board surface. For example, if the pattern is such that the size of perforation stepwisely or gradually varies, appropriate setting of the size of the through-hole and recess is made in accordance with a rule of the pattern. In such embodiments, each of the cross-sectional shapes of the through-hole and the recess can be an arbitrary shape, e.g., a polygon such as a triangle, square or pentagon, or a circle.

Preferably, a substrate of the board is a gypsum board and the bottom face of the recess is formed by a liner paper for gypsum board. The recess is stamped on the surface of the board by unheated compression-forming for locally compressing the substrate, such as press-forming. The bottom face and the side face in the recess are covered with the liner paper. Preferably, the depth of the recess from the surface of the board is determined, taking into consideration of a visual effect of the recess, as well as reduction of strength, breakage under tension, sharing, damage or deterioration of the liner paper which may occur on the periphery of the recess during press-forming. For example, it is desirable to increase the depth of recess to provide an equal visual effect of the recess and the through-hole. However, during screwing or driving the fixing element, the liner paper of the bottom face is apt to be separated and released therefrom by a reaction force of the screwed or driven fixing element. On the other hand, if the depth of recess is decreased, it may be possible to avoid such a condition. However, a problem is caused in which the recess and the through-hole give different visual effects to the observers, or paint deposits on the bottom face of the recess during painting of the surface of the board. For this reason, the depth of the recess is set to be, preferably, in a range from 0.1 mm to 2.0 mm, more preferably, in a range from 0.3 mm to 1.0 mm. It is preferred that the liner paper is colored beforehand in the aforementioned color of the bottom face, or a coat of paint having the aforementioned color of the bottom face is applied to the bottom face and the exposed part of the fixing element.

In a case where the recess is stamped by press-forming or the like, it is preferred to consider reduction of strength, breakage under tension, sharing, damage or deterioration of the liner paper which may occur on the periphery of the recess during press-forming, as well as breakage of the liner paper which may be caused by the force acting on the liner paper when the fixing element is screwed or driven to the board. As an example of concrete countermeasures, the basis weight (weight per unit area) of the liner paper is set to be in a range from 150 g/m$^2$ to 250 g/m$^2$, preferably, equal to or greater than 200 g/m$^2$. As another example of the countermeasures, a chemical effecting adhesiveness between the core and the liner paper is added in a process of manufacturing a gypsum board, whereby the defect occurring during press-forming as set forth above is eliminated.

There is a range of the specific gravity of the gypsum board appropriate to the depth of the recess. If the specific gravity is not in such a range, exfoliation of the liner paper is apt to be caused by destruction of the core during compression. In consideration of such exfoliation, the specific gravity of the core is set to be in a range from 0.5 to 1.0, preferably in a range from 0.7 to 0.9. In general, natural gypsum, chemical gypsum and recycled gypsum are used as raw materials of gypsum board. It is desired that the ratio of recycled gypsum is reduced.

It is desired that reinforcement material such as grass fibers are added to a core in a process of manufacturing a gypsum board, so as to prevent reduction of strength and fire resistance of the gypsum board owing to creation of the perforations. When the board is provided on the ceiling, the grass fibers also act to prevent deflection of the board. Further, it is desired that boric acid or the like is added to the material of the core for preventing the deflection.

Preferably, a sheet such as a sheet of paper or a resin sheet is laid over the through-hole on the reverse face side of the board. Such a sheet overlaid on the reverse face side enables to prevent a flame from acting on the reverse face of the board through the hole. Particularly, in consideration of the fire resistance, an incombustible sheet including glass fibers and an inorganic matter is preferably used as the aforementioned sheet. Calcium carbonate, calcium silicate, aluminum hydroxide, sepiolite, zeolite and so forth can be exemplified as the inorganic matter.

In another embodiment of the present invention, a covering layer having a predetermined thickness is overlaid on a right face of the substrate of the board, except the perforation. The bottom face of the recess is formed by the surface of the substrate, and the side face of the recess is formed by an edge of the covering layer. Preferably, the covering layer is formed by a relatively thick coat of paint or coating material on a right face of the substrate. According to such an arrangement, a recess can be formed at an uncovered part, and the depth of the recess is set to be the thickness of the covering layer. The thickness of the layer is set to be, preferably, in a range from 0.1 mm to 2.0 mm, more preferably, in a range from 0.3 mm to 1.0 mm.

BEST MODE FOR CARRYING OUT THE INVENTION

With reference to the attached drawings, preferred embodiments of the present invention are described hereinafter.

First Embodiment

Figure 1:
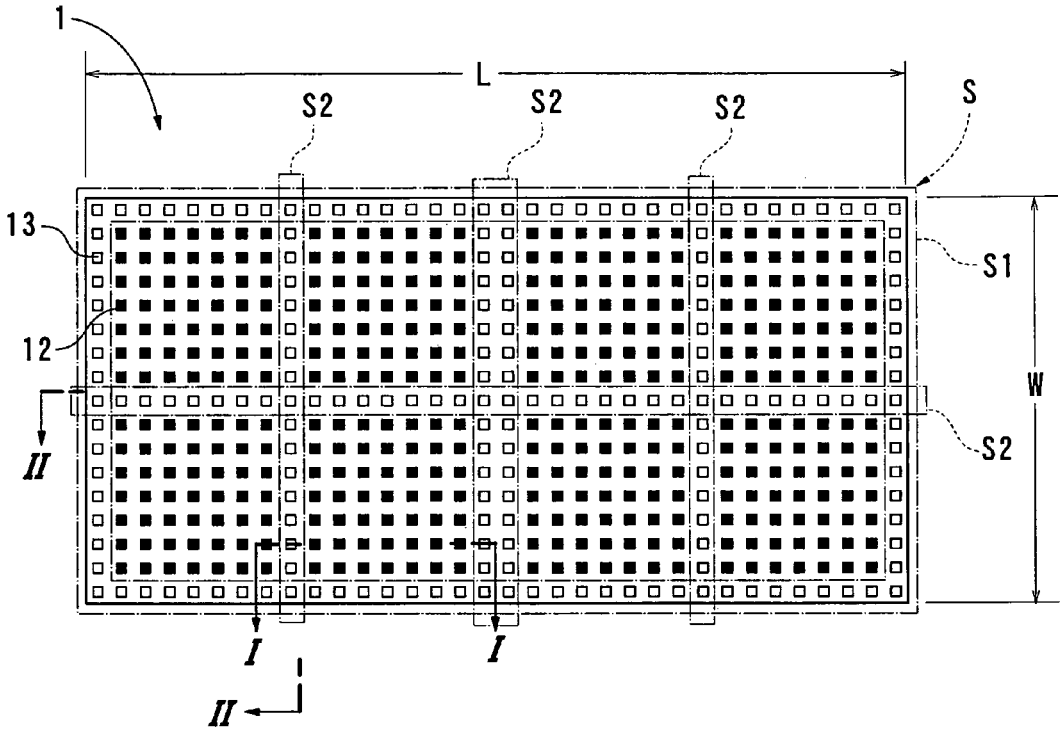
FIG. 1 includes a front elevational view and a cross-sectional view taken along line I-I, in which a perforated board for building material is illustrated as a first embodiment of the present invention.
Figure 1:
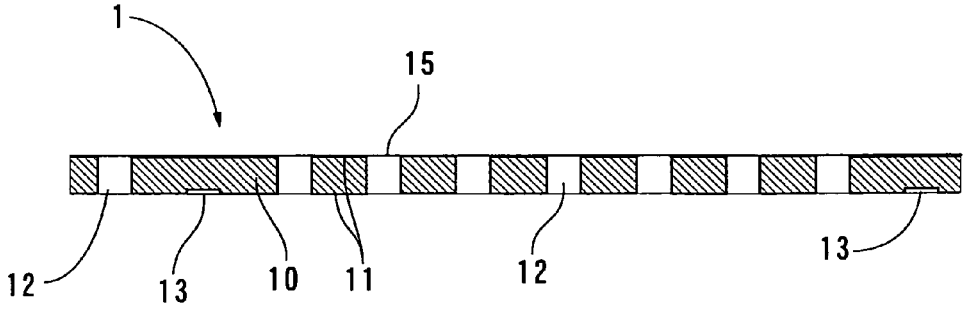
Figure 2:
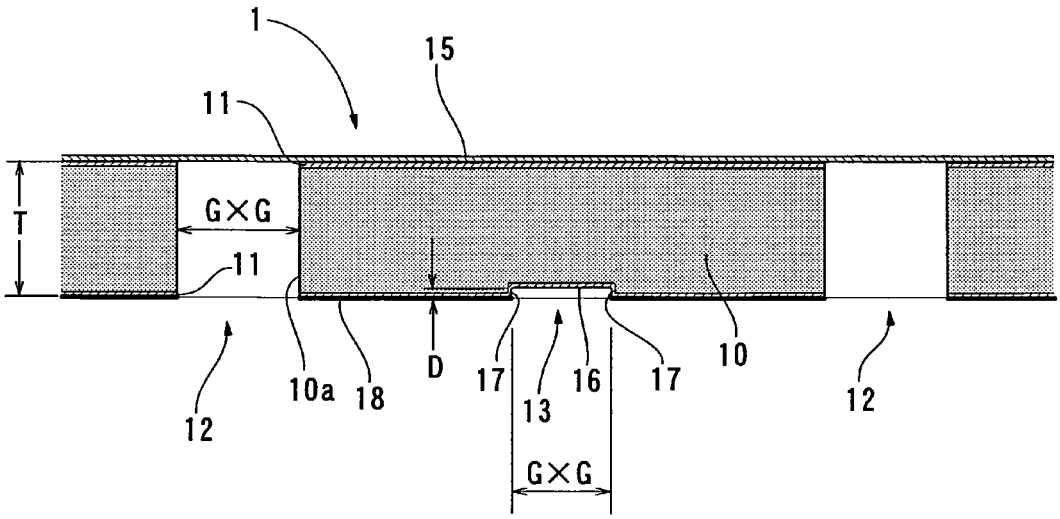
FIG. 2 includes a partially enlarged cross-sectional view and a partially enlarged perspective view of the board as shown in FIG. 1.
Figure 2:
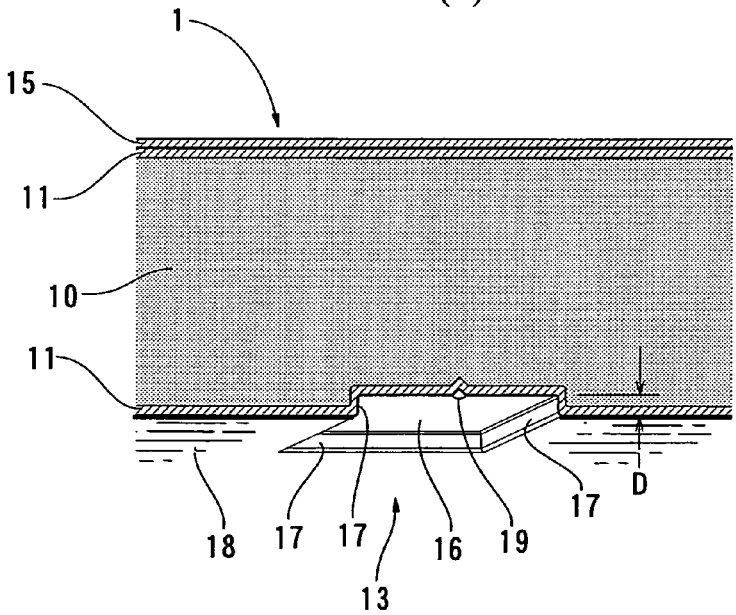
Figure 19:
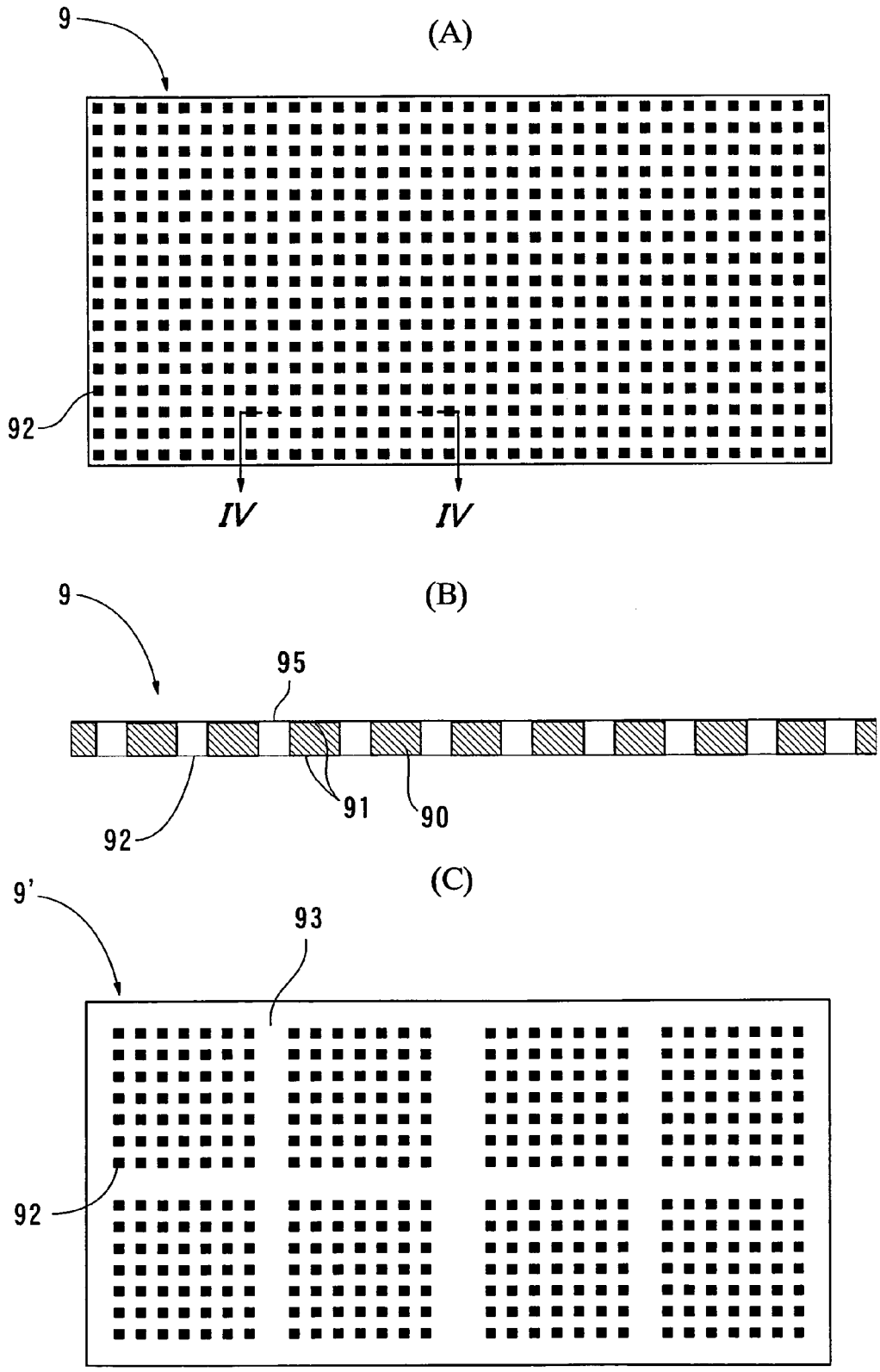
FIG. 19 includes a front elevational view, a cross-sectional view taken along line IV-IV, and a rear elevational view showing a comparative example of the board.

FIGS. 1 and 2 include a front elevational view, a cross-sectional view taken along line I-I, a partially enlarged cross-sectional view and a partially enlarged perspective view showing an arrangement of a perforated board for building material, which is a first embodiment according to the present invention. FIG. 19 includes a front elevational view, a cross-sectional view taken along line IV-IV, and a rear elevational view showing a comparative example of the board.

A perforated board for building material 1 comprises a substrate, which is a gypsum board of a predetermined thickness T (e.g., thickness T=9.5 mm) having a gypsum core 10 covered with sheets of gypsum board liner paper 11 on its both faces. The board 1 has a rectangular profile of a predetermined size W×L (e.g., 455 mm×910 mm) as seen in the front elevational view. A sheet of backing paper 15 is overlaid on a reverse face of the board 1. The sheet 15 is adhered to the reverse face of the gypsum board by an adhesive. A sheet of material including glass fibers and an inorganic substance can be preferably used as the sheet 15.

The board 1 is formed with a number of bored square through-holes 12. Each of the holes 12 illustrated as black squares in FIG. 1(A) extends through the core 10 and the sheets 11, as shown in FIG. 2. Edges of the sheets 11 and an edge 10*a* of the core 10 are exposed in each of the holes 12. A visual impression of the holes 12 depends on tones of colors of the core 10 and the sheets 11, 15, and natural or artificial light entering the holes 12 and its vicinities.

In FIGS. 19(A) and 19(B), there is shown a perforated board for building material 9 which is a comparative example. The board 9 also has a number of square through-holes 92 illustrated as black squares. Each of the holes 92 extends through a gypsum core 90 and sheets of gypsum board liner paper 91. A sheet of backing paper 95 is overlaid on a reverse face of the board 9. The board 9 has the holes 92 distributed or dispersed uniformly over a whole area of the board 9. Non-perforated areas for fixing screws and so forth should be ensured for securing the board 9 to an interior finish base material by fixing screws or the like. Therefore, non-perforate areas 93 are provided in a peripheral zone and transversely extending zones of the board, as in the board 9' shown in FIG. 19(C). However, architectural design of the board 9 is restricted, owing to such non-perforated areas 93.

As shown in FIG. 1, the board 1 of this embodiment has a number of square recesses 13 illustrated as white squares in FIG. 1(A) which are disposed in non-perforated areas S, in alignment with the through-holes 12. The areas S include a peripheral part S1 and transverse parts S2. The part S1 extends in areas of side edges and end edges of the board 1 (i.e., peripheral zone), whereas the part S2 extends in parallel with the side or end edge of the board 1.

As shown in FIG. 2, openings of the through-hole 12 and the recess 13 are set to have the same size G×G Preferably, the dimension G is set to be at least 8 mm, in consideration of a size of a fixing element, workability of fixing work, a securing strength of the fixing element, and so forth. For instance, the recess 13 is stamped on a surface of the gypsum board by pressing. A space in the recess 13 is defined by a bottom face 16 and side faces 17. A depth D of the recess 13 is set to be in a range from 0.1 mm to 2.0 mm, preferably in a range from 0.3 mm to 1.0 mm. In this embodiment, the depth D of the recess 13 is set to be in this range, in consideration of reduction of the strength of the sheet 11, breakage of the sheet 11 under tension, shearing of the sheet 11, damage or deterioration of the sheet 11, or the like, which may be otherwise caused at a boundary of the recess during a pressing process. However, if a gypsum-based board without the sheets 11 or a board of the other material is used, it is possible to set the depth D of the recess 13 to be a dimension greater than the aforementioned dimension.

The sheet 11 on a right face side of the board 1 is colored beforehand in a hue, a brightness and a saturation of color such that the recess 13 and the through-hole 12 give an equal visual impression to a viewer (a resident and so forth in a room). A finish coat of paint is applied to the sheet 11 so that a paint film 18 is provided thereon. The paint film 18 is formed on an overall surface of the board except the openings of the holes 12 and the recesses 13, so that an interior finish surface exposed to the interior space is formed. Although the sheet 11 is exposed on the bottom face 16 and the side faces 17 of the recess 13, the sheet 11 colored as set forth above gives to the resident in the room, a visual impression equal to that of the through-holes 12, in relation to the color of the paint film 18 and the depth D of the recess 13.

A coat of paint different from the interior finish coat of paint may be applied to the sheet 11 in the recess 13. In such a case, a paint of a hue, a brightness and a saturation of color, which give the resident a visual impression equivalent to that of the hole 12, is selected as a paint to be applied in the recess 13. Preferably, a head of a screw exposed to the interior space is also coated with a paint having a hue, a brightness and a saturation of color which provide a visual impression equal to that of the bottom face 16 and the side faces 17 of the recess 13.

Figure 3:
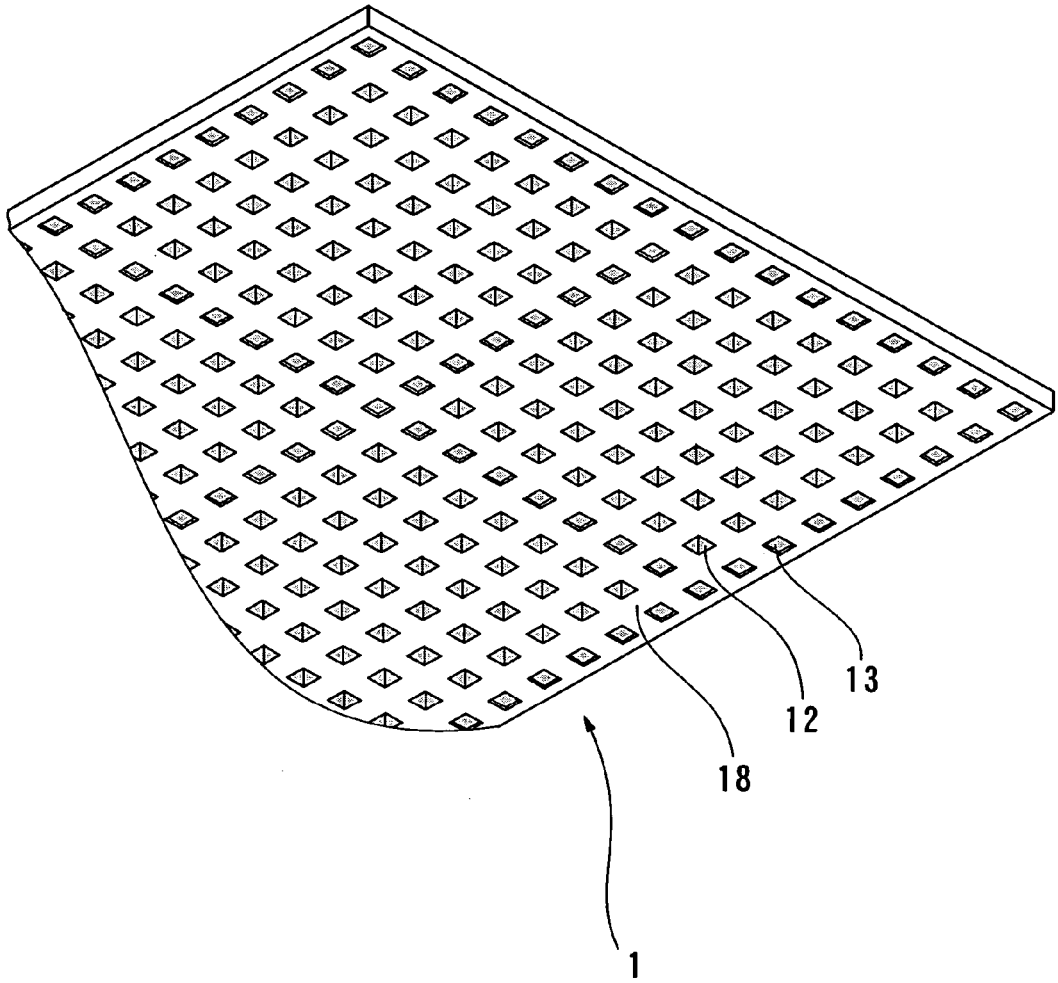
FIG. 3 is a partial perspective view of the board shown in FIGS. 1 and 2, as seen from an interior of a room.

FIG. 3 is a partial perspective view of the board 1 as seen from the interior space.

As the recess 13 forms a simulative through-hole which takes a visual effect equivalent to that of the through-hole 12 in the non-perforated zone S, the board 1 is visually recognized as a perforated board which has through-holes regularly and uniformly arranged over the whole area of the board.

Figure 4:
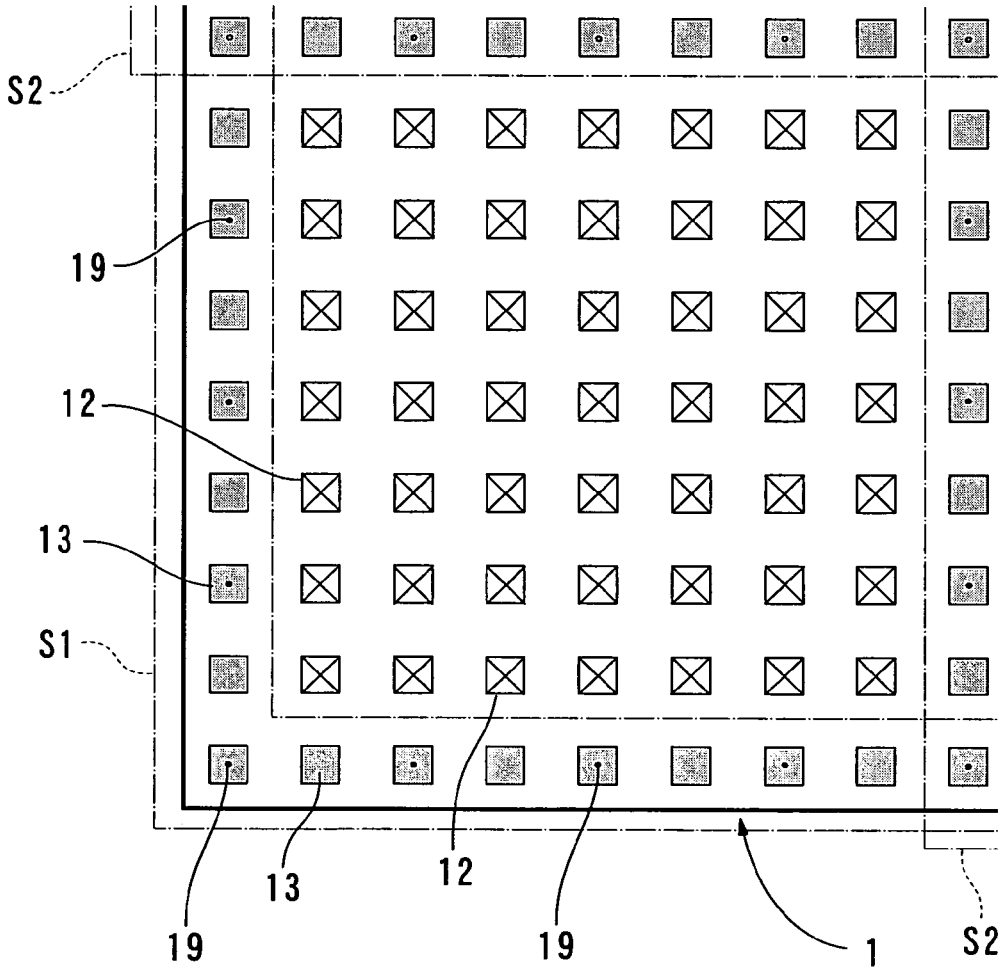
FIG. 4 is an enlarged front elevational view of a section defined by line II-II shown in FIG. 1.

FIG. 4 is an enlarged front elevational view of a section defined by line II-II shown in FIG. 1.

The recesses 13 in predetermined positions are formed with positional indexes 19 for board fixing screws. Each of the indexes 19 is a small dent which is stamped at a center of the bottom face 16 as shown in FIG. 2(B). In this embodiment, each of the dents is set to be very small in its size, but the dent may be designed to have a larger size so that a power for screwing or driving the fixing element (screwing power or driving power) can be reduced. This also makes it possible to restrict separation of the gypsum board liner paper (separation of the paper from the bottom face caused by a reaction force occurring during screwing or driving). It is not necessary to provide the indexes 19 in all of the recesses 13 in alignment, but the indexes 19 may be formed only in the recesses 13 corresponding to preliminarily assumed screwing positions, which are based on assumed locations and intervals of the board fixing screws. In this embodiment, the recess 13 with the index 19 and the recess 13 without the index 19 are alternately arranged.

FIGS. 5(A) and 5(B) are partially enlarged cross-sectional views showing a manner of securing the board 1 to an interior finish base material 60.

As shown in FIG. 5(A), the board fixing screw 70 is positioned in a screwing position in which a tip 72 is centered at the index 19. The screw 70 is driven into the board 1 by a rotating tool such as a screwdriver (not shown), and screwed into the base material 60. As illustrated in FIG. 5(B), the screw 70 is screwed to an extent that a screw head 71 matches with the bottom face 16 so as to presses the sheet 11 of the bottom face 16. The screw 70 stays in a stationary condition in which a top face of the screw head 71 is flush with the sheet 11. Thus, the board 1 is fixed to the base material 60 by a securing force of the screw 70.

FIG. 5(C) includes a perspective view and a partially enlarged cross-sectional view showing a structure of the top face of the screw head 71.

The board 1 is secured to the base material 60, such as a ceiling joist, in a condition that the screw head 71 is contained in the recess 13 as shown in FIG. 5(B). Usually, the screw head 71 has a nature to reflect the natural or artificial light, and its manner of reflecting the light somewhat differs from that of the board 1. For example, when the light enters the recess 13 in a certain direction, a reflected light of the screw head 71 is emitted therefrom in a manner different from that of its surroundings, and thus, the existence of the screw head 71 is apt to be visually conspicuous. Means for preventing such a condition is exemplified in FIG. 5(C). That is, minute indentations 75 are provided on the top face of the screw head 71 and a coat of paint is applied thereto so as to form a paint film 74. The indentations 75 are formed, for instance, by forming minute undulations on the top face of the screw head in a manufacturing process of the screw 70, or making the top face of the screw 70 to be a matte finish surface. A minutely indented pattern, such as an embossed pattern, is formed on the top face of the screw head by the paint film 74, whereby the light is diffusely reflected therefrom. Therefore, it is possible to avoid a condition that the top face of the screw head becomes visually conspicuous by the light entering in a certain direction. Preferably, the paint film 74 is applied beforehand in a plant.

Figure 6:
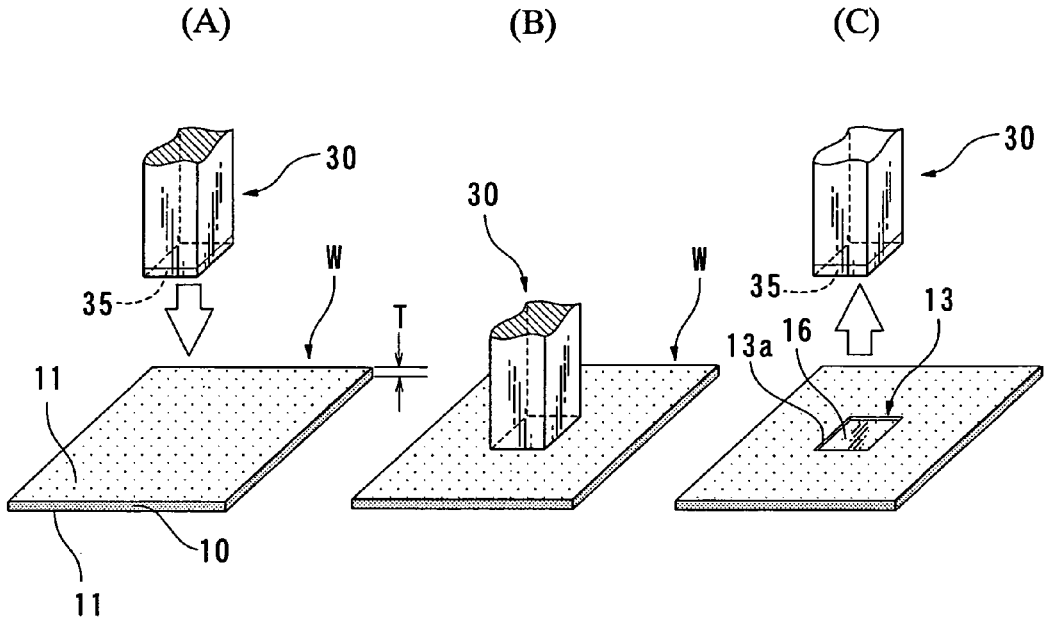
FIG. 6 includes perspective views illustrating a process for forming the recess.
Figure 7:
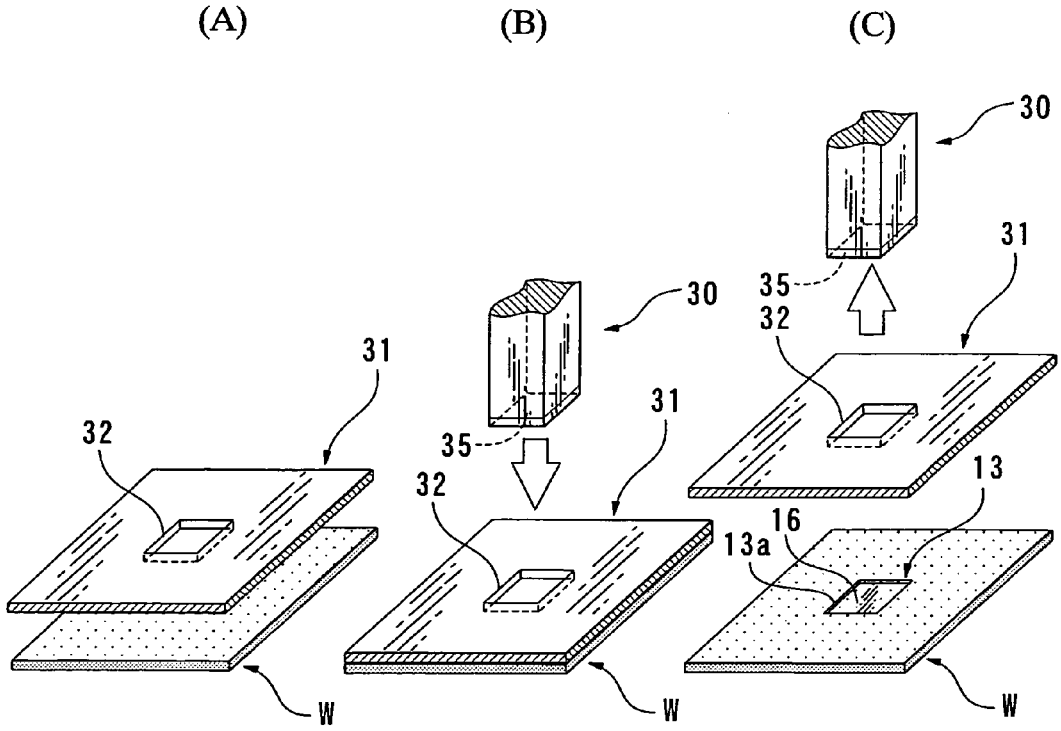
FIG. 7 includes perspective views illustrating another process for forming the recess.

FIGS. 6 and 7 include perspective views and cross-sectional views illustrating a process for forming the recess 13 on the substrate W for the board 1.

The substrate W is a gypsum board of a predetermined thickness T (e.g., thickness T=9.5 mm) which has a gypsum core 10 covered with sheets of the gypsum board liner paper 11 on its both faces. A male die 30 is used in the process as shown in FIG. 6. In the process as shown in FIG. 7, the male die 30 and a guide plate 31 are used.

The process as shown in FIG. 6 is the most basic process for forming the recess, wherein an lower end portion of the male die 30 is vertically pressed against a horizontal upper surface of the substrate W (FIG. 6(A)) by a driving device (not shown). The male die 30 is provided with a flat pressing face 35 which slightly penetrates into the upper surface of the substrate W so that the substrate W is locally compressed (FIG. 6(B)). The driving device lifts up the male die 30, and the recess 13 is formed on the upper surface of the substrate W (FIG. 6(C)).

The substrate W thus formed with the recess 13 is finished by painting with use of a painting or coating device, such as roll coater. According to experiments of the present inventor, if the depth D (FIG. 2) is set to be less than 0.3 mm, the painting or coating material tends to be applied to not only the surface of the substrate W but also the bottom face 16 of the recess 13. Therefore, it is difficult to apply a coat of paint only to the surface of the substrate W (as the result, relatively many defective products are produced). On the other hand, if the depth D (FIG. 2) exceeds 1 mm, the sheet 11 tends to be broken or weakened at a stepped formation of an edge portion 13*a* of the recess 13, whereby the sheet 11 of the bottom face 16 is apt to be separated from the gypsum core 10. This may result in an impaired workability such that the sheet 11 is released from the bottom face 16 by the reaction force of the tightened screw when the screw is tightened into recess 13. Thus, the depth D (FIG. 2) is set to be preferably in a range from 0.3 mm to 1 mm, more preferably in a range from 0.4 mm to 0.8 mm, especially in a case where the gypsum board is used as the substrate W.

In the process as shown in FIG. 7, the guide plate 31 provided with a guide hole 32 is used (FIG. 7(A)). A lower surface of the guide plate 31 abuts against the upper surface of the substrate W. The guide hole 32 is located in position in which the recess 13 is to be formed (FIG. 7(B)). An outline and a size of the guide hole 32 are substantially identical with the shape and the size of the cross-section of the male die 30. The male die 30 is inserted into the guide hole 32 and vertically pressed against the upper surface of the substrate W. After the male die 30 and the guide plate 31 are lifted, the form of recess 13 remains on the upper surface of the substrate W (FIG. 7(C)). Use of such a guide plate 31 allows the recess 13 to be formed accurately in angles of its projected or recessed corners, and therefore, it is possible to form or define the configuration of the recess 13 relatively sharply or precisely.

Preferably, the device for forming the recess as illustrated in FIG. 7 further comprises, in addition to the guide plate 31, a penetrating member arranged to transitionally penetrate the surface of the board. This penetrating member abuts against the upper surface of the substrate W when the guide plate 31 moves downward. The penetrating member penetrates the sheet 11 to locally shear or break the sheet 11, when the guide plate 31 presses the substrate W. As the result, a number of slits, small apertures or the like are formed on the upper surface of the substrate W in alignment with each other and in coincidence with an outline of the recess 13. The recess thus formed has its edge portions relatively accurately deformed and bent by the pressure of the male die, and therefore, the angles of the corners of the recess are considerably precisely formed. Thus, it is possible to form or define the configuration of the recess sharply or precisely with use of such a penetrating member. The male die 30 may be provided with a small projection at a center of its lower face. This projection stamps a dent constituting the aforementioned index 19 on the substrate W. Further, in the process as set forth above, the guide plate 31, the male die 30 and the aforementioned penetrating member may be simultaneously lowered down to the substrate W so that forming of the aforementioned slits or small apertures and forming of the recess are simultaneously carried out.

Second Embodiment

Figure 8:
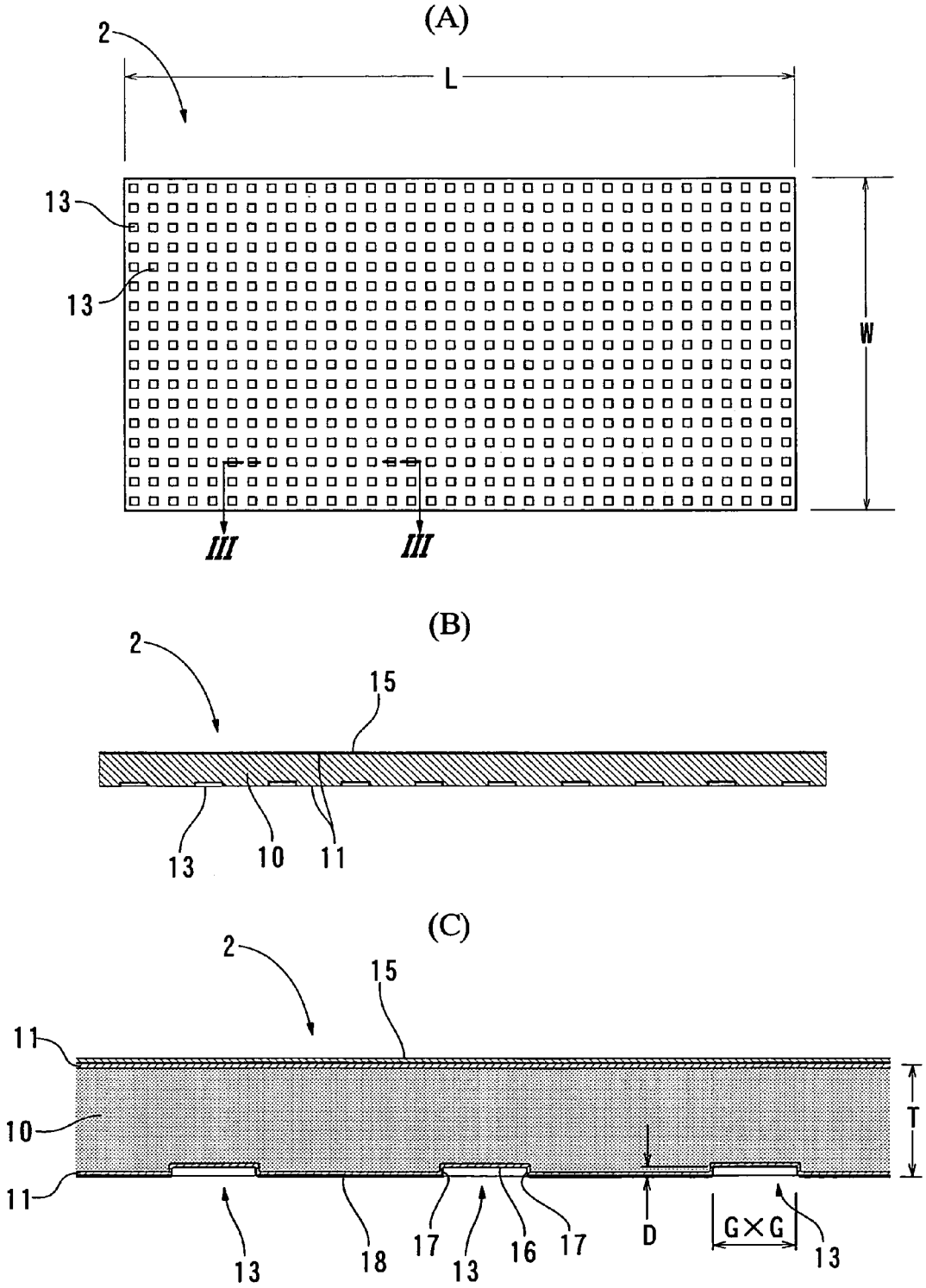
FIG. 8 includes a front elevational view, a cross-sectional view taken along line III-III, and a partially enlarged cross-sectional view, which show the board of a second embodiment according to the present invention.
Figure 9:
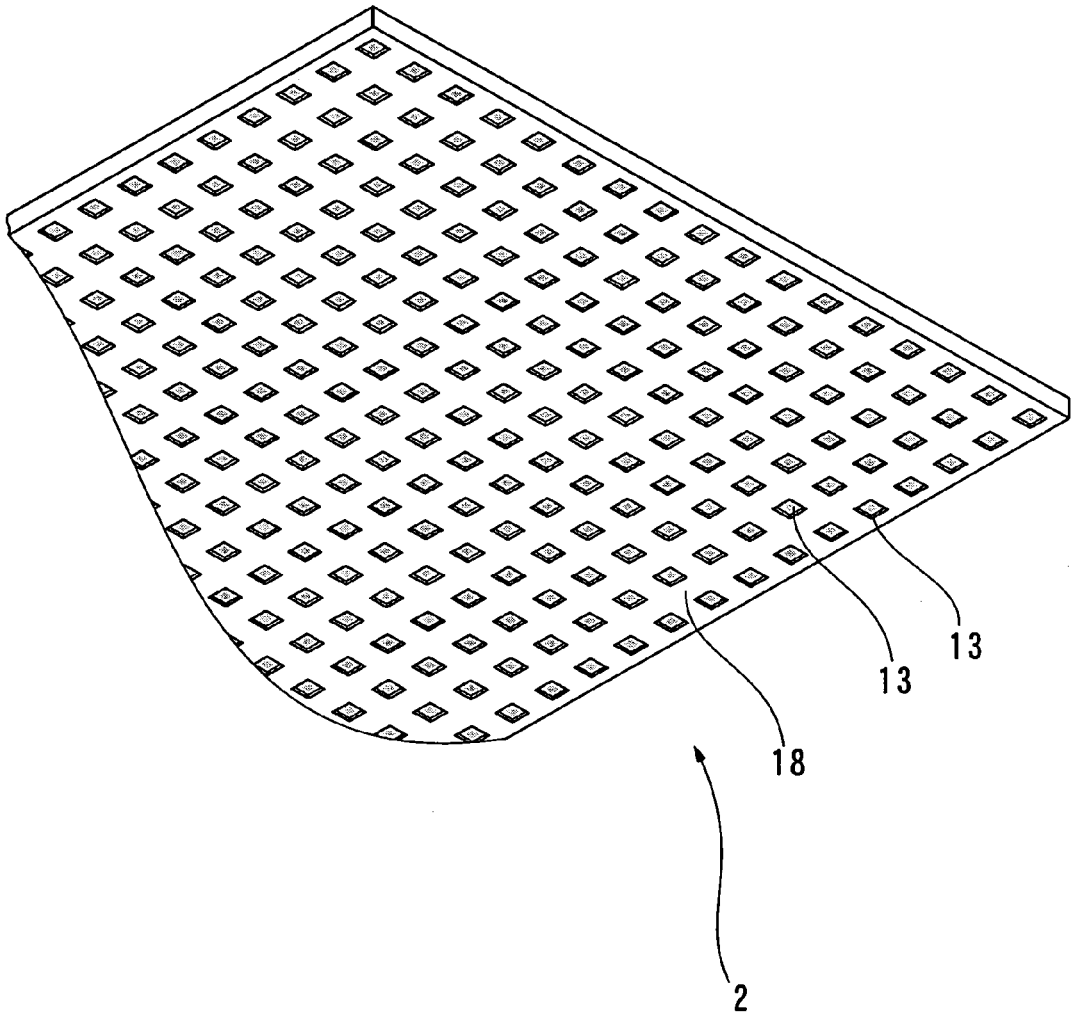
FIG. 9 is a partial perspective view of the board as shown in FIG. 8.

FIG. 8 includes a front elevational view, a cross-sectional view taken along line III-III, and a partially enlarged cross-sectional view, which show the board of a second embodiment according to the present invention. FIG. 9 is a partial perspective view showing the board as shown in FIG. 8.

In FIGS. 8 and 9, there is illustrated, a board for building material 2 produced from a substrate which is the same gypsum board as that of the first embodiment. Similarly to the board 1 of the first embodiment, the board 2 is made of the gypsum board having the thickness T (e.g., thickness T=9.5 mm), which has the gypsum core 10 covered with the sheets of gypsum board liner paper 11 on its both faces. As viewed in the front, the board 2 has a rectangular profile of a predetermined size W×L (e.g., 455 mm×910 mm). The sheet of backing paper 15 is overlaid on a reverse face of the board 2. If desired, the sheet 15 can be omitted.

Similarly to the board 1, the board 2 is provided with the recesses 13 in an area for securing the board to the interior finish base material with use of the board fixing screws. The size G×G and the depth D of the recess 13 are set to be the same as those of the recess 13 of the board 1.

The board 2 differs from the aforementioned board 1 in that the board 2 is not provided with the through-hole 12 at all, and that the recesses 13 are formed in positions where the through-holes 12 in the aforementioned board 1 (FIG. 1) may be otherwise located. Therefore, the board 2 has the same configuration as that of the board 1 as seen in the front view, but the board 2 has the recesses 13 uniformly distributed over the whole area. That is, the board 2 does not have the through-holes taking the sound absorption effects, at all.

The sheet 11 positioned on the right face side of the board 2 is colored beforehand in a hue, a brightness and a saturation of color so as to provide a visual impression equivalent to the through-hole 12 of the board 1 (FIG. 1), whereby the recesses 13 gives the resident or the like, an impression equivalent to the through-holes 12 (FIG. 1). A finish coat of paint is applied to the sheet 11 so that the paint film 18 is formed thereon. The paint film 18 is formed on the overall surface of the board except the recesses 13. Although the sheet 11 is exposed on the bottom face 16 and the side faces 17 of the recess 13, the sheet 11 colored as set forth above gives the resident or the like, an visual impression equivalent to that of the through-hole 12 (FIG. 1), in connection with the color of the paint film 18 and the depth D of the recess 13.

A coat of paint different from the paint for the interior finish surface may be applied to the sheet 11 in the recess 13, similarly to the recess 13 of the board 1. In such a case, the sheet 11 in the recess 13 is painted by a paint having a hue, a brightness and a saturation of color which provide a visual impression equivalent to that of the through-hole 12 (FIG. 1). It is desired that a head of a screw exposed to the interior space is also coated with a paint having a hue, a brightness and a saturation of color which provide a visual impression equivalent to that of the bottom face 16 and the side faces 17 of the recess 13. Preferably, the head of the screw used for securing the boards 1 has a pattern of minute indentations painted in a plant (FIG. 5(C)).

It is preferred that the recesses 13 in predetermined positions are provided with the positional indexes for the board fixing screws (not shown), similarly to the aforementioned embodiment.

As illustrated in FIG. 9, the recess 13 forms a simulative through-hole on the board 2 so that the recess 13 takes a visual effect equal to that of the through-hole 12 of the board 1 (FIG. 1). Therefore, the board 2 is visually recognized as a perforated board for building material which has through-holes uniformly arranged on the whole area of the board.

Figure 10:
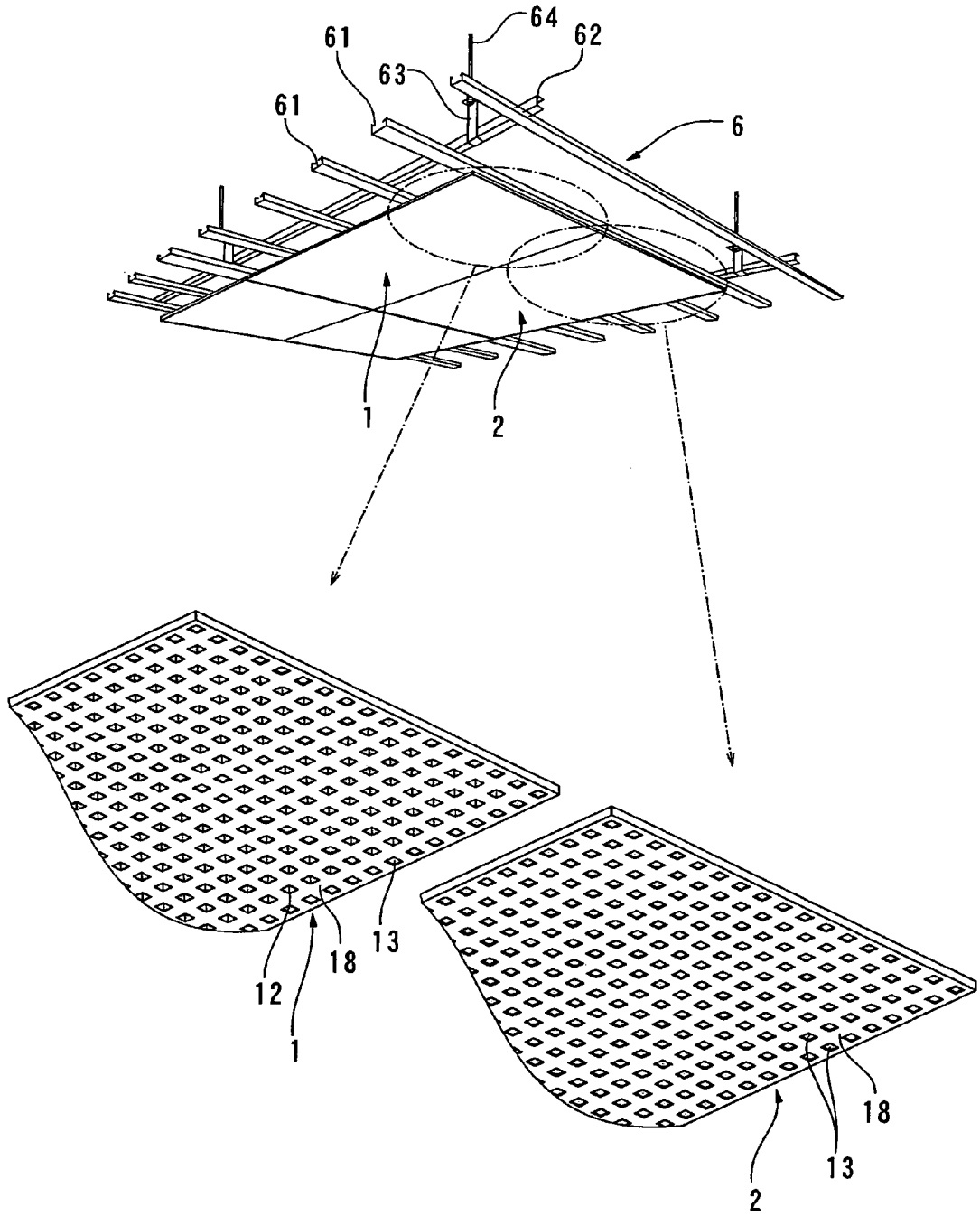
FIG. 10 is a perspective view showing an example of construction in which a ceiling is constructed by the board with the recesses partially disposed thereon and the board with the recesses disposed over the whole area thereof.

FIG. 10 is a perspective view showing an example of construction in which the boards 1, 2 are provided on a ceiling.

Figure 5:
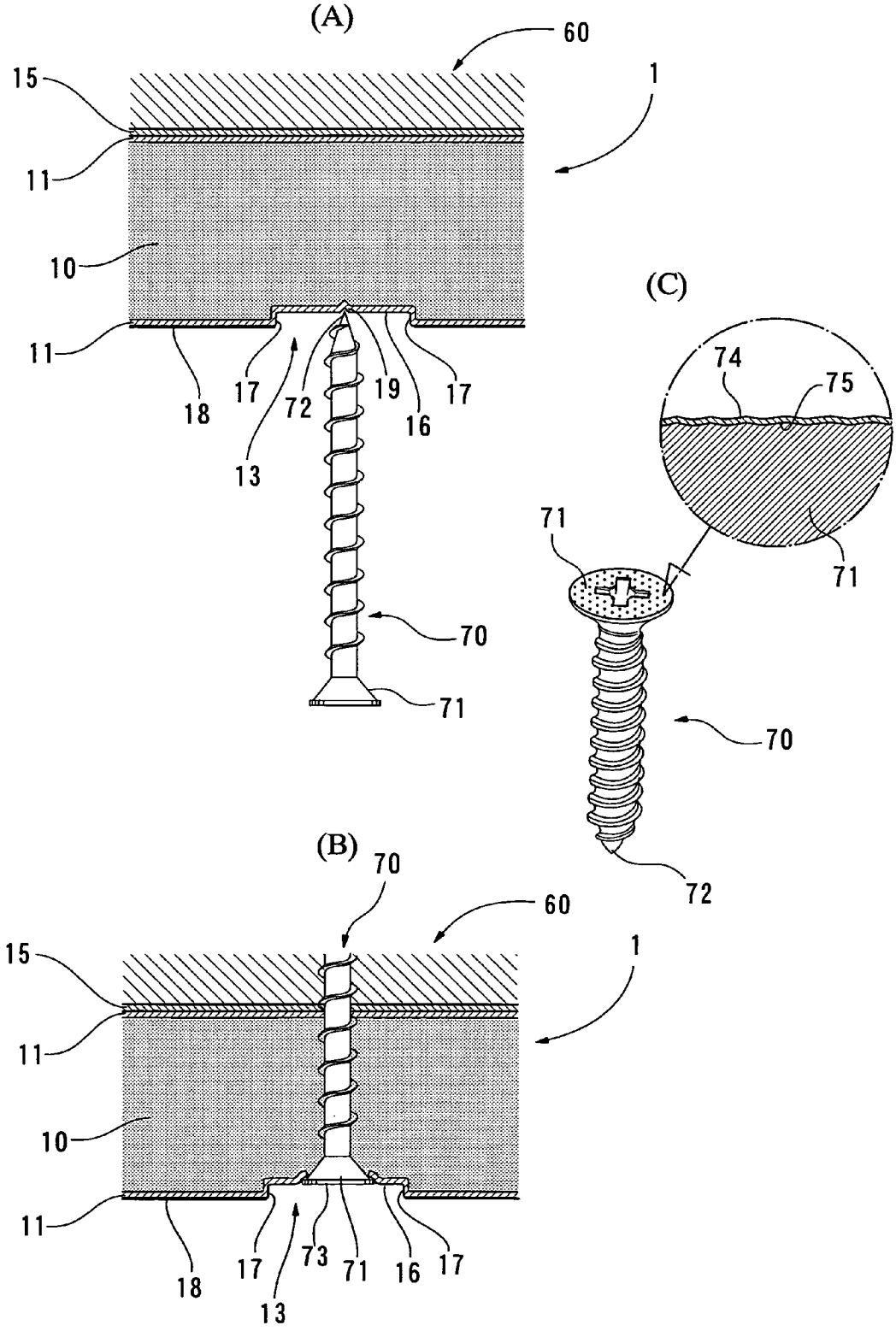
FIG. 5 includes partially enlarged cross-sectional and perspective views which show a manner of driving a board fixing screw into a recess and securing the board to an interior finish base material.

A steel ceiling furring structure 6 is constructed by lightweight steel ceiling joists 61, support members for the joists 62, hangers 63 and hanging bolts 64. The boards 1, 2 are secured to the joists 61 by the board fixing screws (not shown). As shown in FIG. 5, the boards 1, 2 are secured to the joists 61 by positioning the screws 70 at the indexes 19 and driving the screws into the bottom faces 16 with use of a rotating tool.

The boards 1, 2 adjacent to each other give visually equivalent impression to the resident or the like, and the ceiling looks as if regularly arranged through-holes are distributed over the whole area of the ceiling. Accordingly, the boards 1, 2 can be provided in a mixed condition, without impairing uniformity or unity of architectural design of the interior finish surface.

Figure 11:
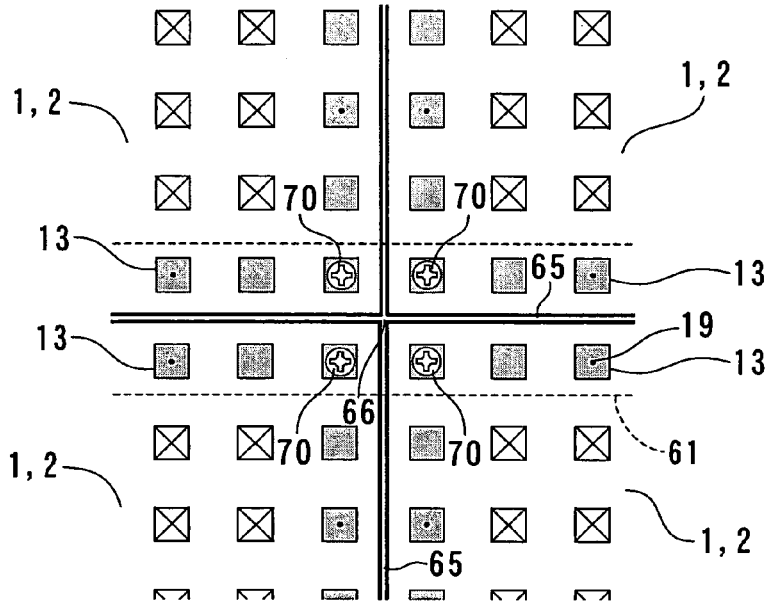
FIG. 11 is a drawing of the ceiling as upwardly viewed, which exemplifies a layout of the screws for the boards.
Figure 12:
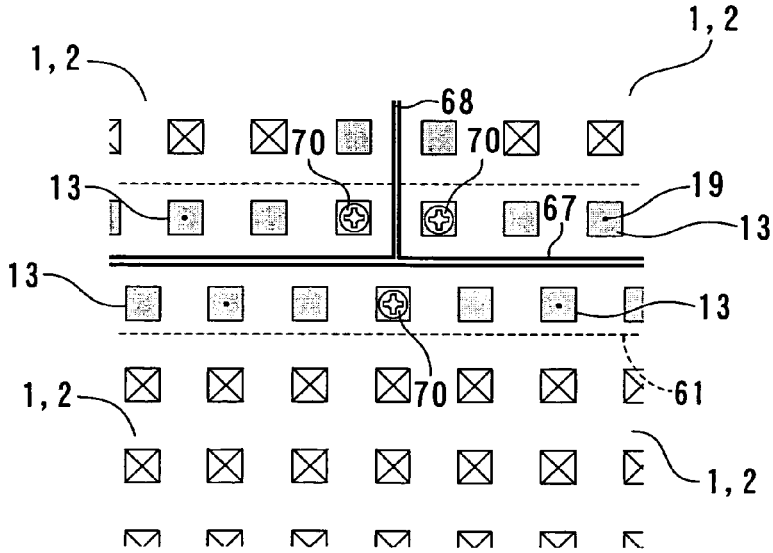
FIG. 12 is a layout drawing of the ceiling as upwardly viewed, which exemplifies a layout of the screws for the boards on the ceiling.

FIGS. 11 and 12 are layout drawings of the ceiling as upwardly viewed, each exemplifying a layout of the screws for the boards 1, 2.

In FIG. 11, an example of construction is shown in which joints 65 of the boards 1, 2 are located in accordance with a square joint formation. The longitudinal and lateral joints 65 perpendicularly cross at an intersection 66. In FIG. 12, another example of construction is shown in which the joints 65 of the boards 1, 2 are located in accordance with a breaking joint formation. A transverse joint 68 butts against a longitudinal joint 67. In each of these two cases, the board fixing screws 40 can be positioned in the appropriate recesses 13.

Figure 13:
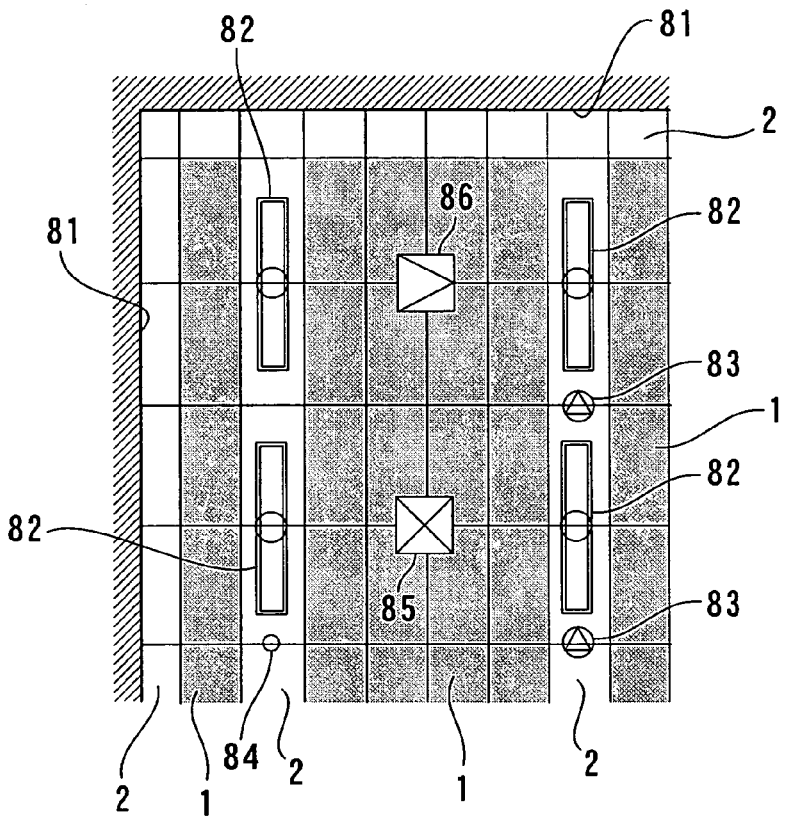
FIG. 13 is a layout drawing of the ceiling constructed with use of the boards.

FIG. 13 is a layout drawing of the ceiling constructed with use of the boards 1, 2.

In FIG. 13, a layout of the boards 1, 2 on the ceiling is exemplified, and the ceiling is partitioned by wall surfaces 81. The joints of the ceiling are arranged in a square joint formation. Usually, building equipment, which includes lighting fixtures 82, speakers 83, emergency lighting fixtures 84, air outlets 85, ceiling hatches 86 and so forth, is provided on the ceiling. Normally, pieces cut from the perforated boards are positioned in vicinity to the wall surface 81, and they are jointed with the wall surfaces 81 by means of wall trims (not shown).

The ceiling as shown in FIG. 13 is constructed mainly with use of the boards 1 having a number of bored through-holes 12. However, if an opening for the building equipment is formed to the board 1 or if the board 1 is cut into small pieces, the strength of the board 1 (its rigidity, bending strength, shearing strength and so forth) tends to be considerably decreased. Therefore, on the ceiling as shown in FIG. 13, the boards 2 having only the recesses 13 are positioned in the vicinity of the wall surface 81 and in zones for installing the building equipment 82, 83, 84.

Alternatively, decorative gypsum boards (e.g., "Gyptone" or "Marbletone" manufactured by Yoshino Gypsum Co., Ltd.) may be positioned in the vicinity of the wall surface 81 or in the zones for installing the building equipment 82, 83, 84.

Figure 14:
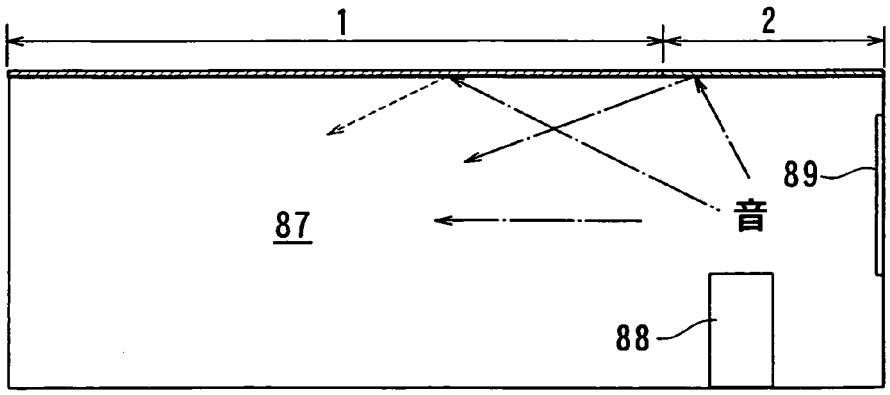
FIG. 14 is a cross-sectional view of a room exemplifying a layout of the boards, wherein acoustic effects of the ceiling is taken into consideration.

FIG. 14 is a cross-sectional view exemplifying a layout of the boards, wherein acoustic effects of the ceiling surface are taken into consideration.

In FIG. 14, there is illustrated a room 87 such as a lecture room or an auditorium, which is provided with a platform 88 and a chalkboard 89 for a teacher, lecturer, expositor or the like. As regards such a room 87, it is considered preferable from a viewpoint of acoustic effects that an area of the ceiling near the platform 88 is finished by ceiling materials with a relatively high acoustic reflectivity (a relatively low sound absorptivity), and that an area of the ceiling away from the platform 88 (an auditor's area) is finished by ceiling materials with the relatively high sound absorptivity (the relatively low acoustic reflectivity). However, in a conventional manner, perforated boards having substantially the same sound absorptivity are provided over the whole ceiling surface from a viewpoint of unity of its architectural design.

However, according to the boards 1, 2 having an arrangement as set forth above, as shown in FIG. 14, it is possible to finish the ceiling near the platform 89 with use of the boards 2 having the relatively high acoustic reflectivity (the relatively low sound absorptivity), and it is possible to finish the ceiling of the auditor's area with use of the board 1 having the relatively high sound absorptivity (the relatively low acoustic reflectivity). The ceiling finished by the board 2 effectively reflects the voice of the teacher, lecturer or the like so that the voice carries to the auditors. The boards 1 in the auditor's area form the ceiling with the sound absorptivity of, e.g., approximately 0.5, so that the acoustic reverberation is restricted for facilitating listening to the voice of the teacher, lecturer or the like. Nevertheless, the ceiling finishing work of the room 87 is entirely executed with use of the boards 1, 2 taking equal visual effects, and therefore, unity of the architectural design of the ceiling is achieved.

Third Embodiment

Figure 15:
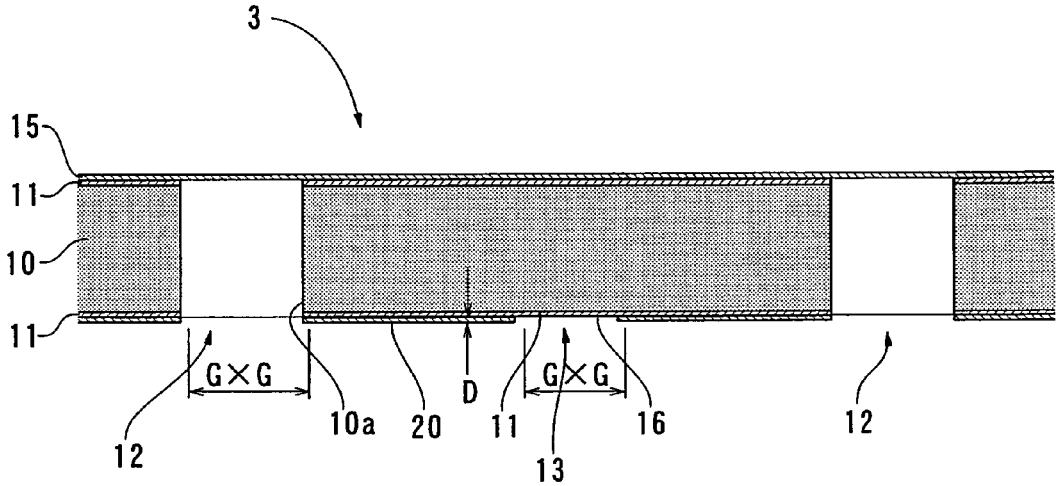
FIG. 15 includes an enlarged cross-sectional view and a partial perspective view showing the board of the third embodiment according to the present invention.
Figure 15:
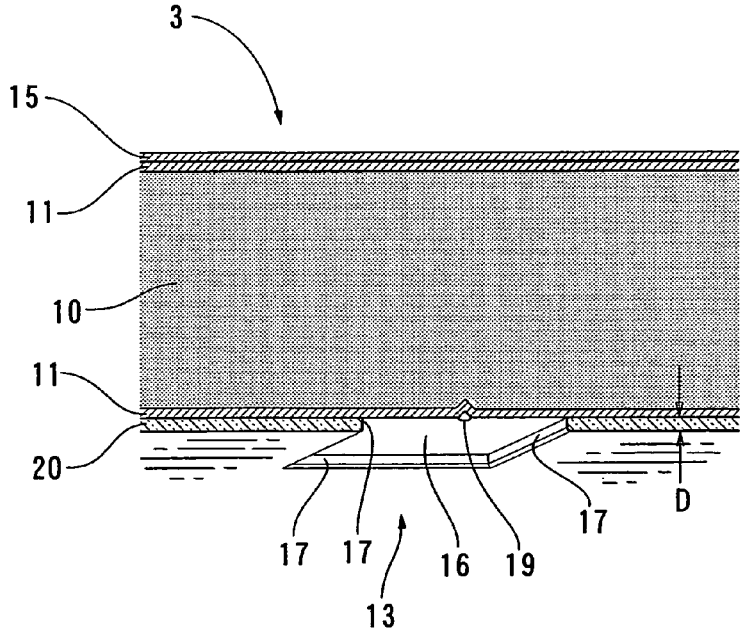

FIG. 15 includes an enlarged cross-sectional view and a partial perspective view which show an arrangement of the board of the third embodiment according to the present invention.

In FIG. 15, there is illustrated a perforated board for building material 3 which has the square through-holes 12 and the square recesses 13. Similarly to the board 1 in the first embodiment, the board 3 is made of a gypsum board of the thickness T (e.g., thickness T=9.5 mm) which has the gypsum core 10 covered with the sheets of gypsum board liner paper 11 on its both faces. As viewed from the front, the board 3 has a rectangular profile of a predetermined size W×L (e.g., 455 mm×910 mm). The sheet of backing paper 15 is overlaid on the reverse face of the board 3.

The sheet 11 positioned on the right face side is colored in a hue, a brightness and a saturation of color to give the resident or the like, a visual impression equivalent to the through-hole 12, whereby the recesses 13 and the through-holes 12 give the resident or the like, a visually equivalent impression. A resin paint, resin coating material and so forth for creating a relatively thick layer 20 is applied to the sheet 11, except for the holes 12 and the recesses 13. The thickness of the layer 20 is set to be in a range of 0.1-2.0 mm, preferably, in a range of 0.4-1.0 mm. Openings of the hole 12 and the recess 13 are set to have the uniform size (G×G). The dimension G is preferably set to be at least 8 mm, in consideration of the size of the fixing element and so forth.

The edges of the sheets 11, the edge 10*a* of the core 10 and an edge of the layer 20 are exposed in the holes 12, and the visual impression of the holes 12 depends on tones of colors of the core 10 and the sheets 11, and natural or artificial light entering the holes 12 and its vicinities thereof. The sheet 11 is exposed on the bottom face 16 of the recess 13. The side face 17 of the recess 13 is formed by the edge of the layer 20.

A coat of paint different from the paint for the interior finish surface may be applied to the bottom face 16 of the recess 13. A paint of a hue, a brightness and a saturation of color, which provide a visual impression equivalent to that of the hole 12, is selected as the paint to be coated on the bottom face 16. Preferably, a head of a screw exposed to the interior space is also coated with a paint of a hue, a brightness and a saturation of color which give a visual impression equivalent to that of the bottom face 16 and the side faces 17 of the recess 13. Preferably, the screws, each having a screw head with a pattern of minute indentations painted in a plant (FIG. 5(C)), are used for securing the boards 1.

Although the present invention has been described as to a preferred embodiments, the present invention is not limited thereto, but may be carried out in any of various modifications or variations without departing from the scope of the invention as defined in the accompanying claims.

Figure 16:
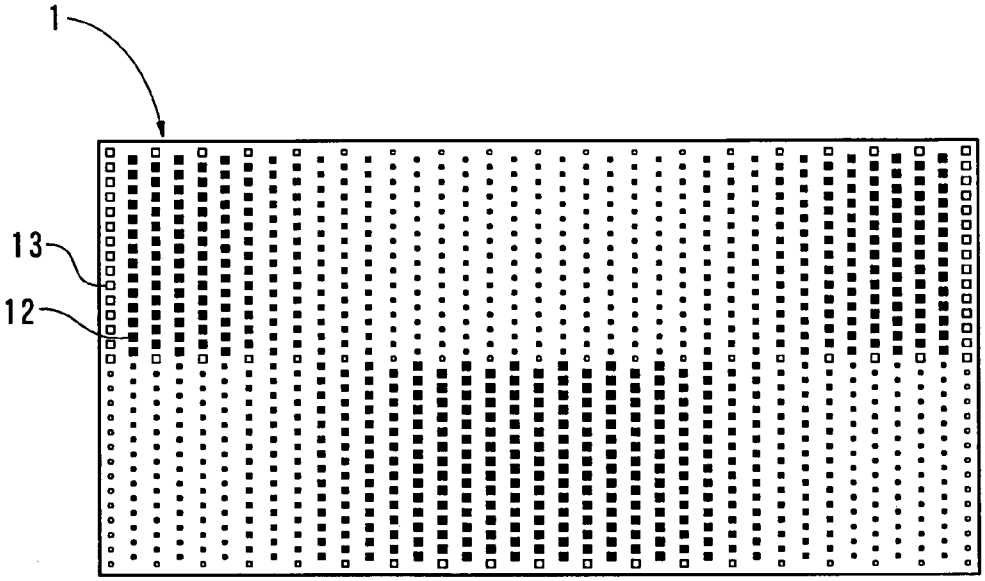
FIG. 16 is a front elevational view showing an example of the board in which a modification of the size and layout of the through-holes and recesses is illustrated.
Figure 17:
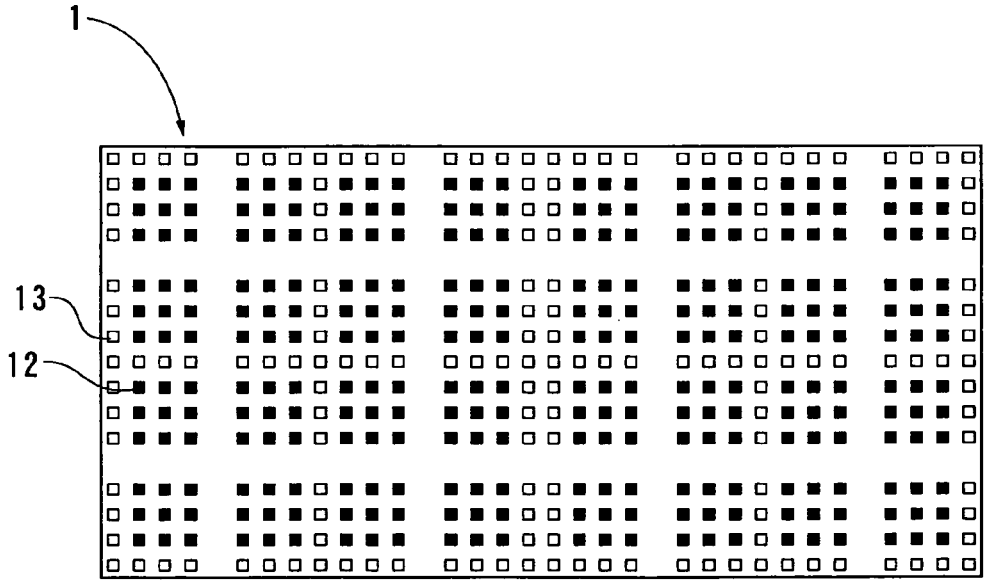
FIG. 17 is a front elevational view showing an example of the board in which another modification of the size and layout of the through-holes and recesses is illustrated.
Figure 18:
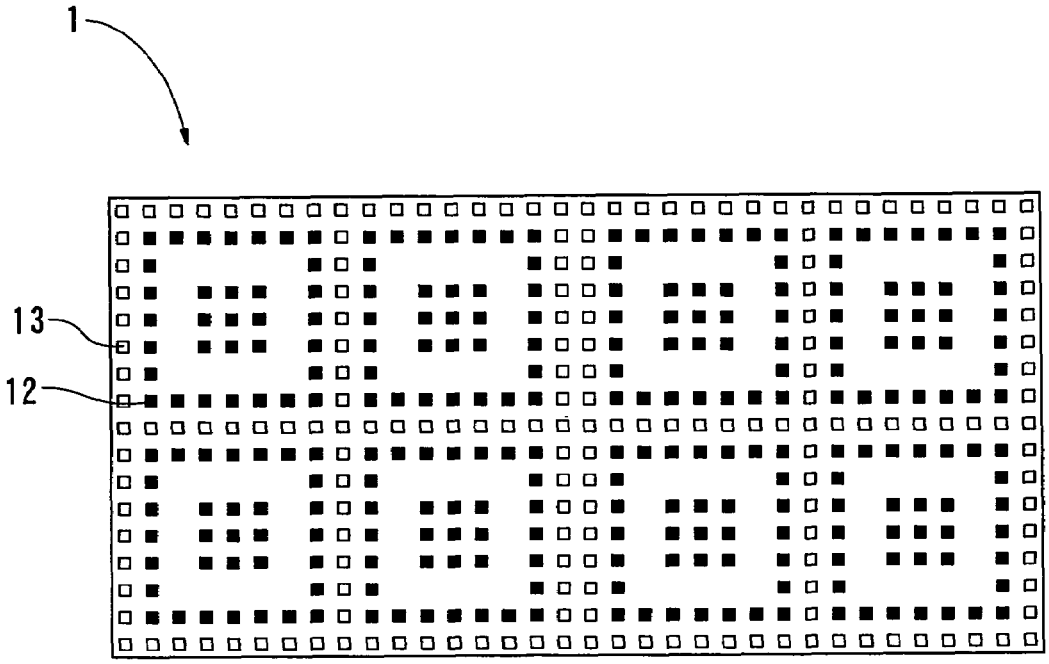
FIG. 18 is a front elevational view showing an example of the board in which still another modification of the size and layout of the through-holes and recesses is illustrated.

For example, in relation to the architectural design, allocation, strength, sound absorption performance or the like of the boards 1, 2, it is possible to suitably change the size of the gypsum board for the board 1, 2, the dimensions and arrangements of the holes 12 and the recesses 13, and so forth. Such boards are exemplified in FIGS. 16 to 18, wherein the boards 1 have different dimensions and arrangements of the holes 12 and the recesses 13.

Further, the substrate of the board 1, 2 is not limited to the gypsum board, but the other material, such as a calcium silicate board or MDF, may be used as the substrate of the board 1, 2.

INDUSTRIAL APPLICABILITY

The perforated board for building material according to the present invention is preferably used as an interior finish board used in an interior finish work. Especially, it is preferably used as a ceiling board to be used in a partitioned space, a room, a specific floor of a building, or a large space such as a hall which should be adjusted in its interior acoustic performance. Further, it is also preferably used as a board of a wall located near a ceiling. The arrangement of the present invention may be applied to an exterior finish material, a sound absorptive board for a high level road or an elevated railway, or the like.

The invention claimed is:

1. A board for use as a building material with a fixing element having a head, the board comprising:

a gypsum board formed with a gypsum core;

a first sheet of liner paper applied to the gypsum board to define a first surface;

a plurality of perforations disposed on the first surface of the board, the perforations being constituted from a number of visible recesses, or a number of visible recesses and visible through-holes, the perforations having a shape that is a polygon or a circle, and said visible recesses being formed on the first surface of the board by compression-forming for locally compressing the gypsum board, and wherein each recess has a visible bottom face that is exposed and formed by the first sheet of liner paper continuously extending from the liner paper on the first surface of the gypsum board without breakage, the bottom face of each visible recess providing a face to be secured by the fixing element thereto, and the exposed head part of the fixing element being contained in the recess.

2. The board as defined in claim 1, wherein a bottom face has a first color and the first surface of the board has a second color, the first color having a brightness of color decreased in comparison with the second color.

3. The board as defined in claim 1, wherein the recesses and the through holes have a predetermined ratio to create a predetermined sound absorption characteristic of the board.

4. The board as defined in claim 1, further comprising a second sheet laid over the through-holes on a reverse face side of the gypsum core to provide a second surface.

5. The board as defined in claim 4, wherein said second sheet is a sheet including glass fibers and inorganic matter.

6. The board as defined in claim 1, wherein the bottom face of a recess has a positioning index for positioning the fixing element, which has a tip.

7. The board as defined in claim 6, wherein said positioning index is a dent, a small aperture or a cross-shaped groove, into which the tip of the fixing element can be inserted.

8. The board as defined in claim 6, wherein said positioning index is positioned at a center of the bottom face.

9. The board as defined in claim 1, wherein a depth of a recess from the first surface of the board is set to be in a range from 0.1 mm to 2.0 mm.

10. A method of producing the board as defined in claim 1, wherein the surface of the board is locally pressed by a flat pressing face of a male die so that the recess of a predetermined depth is formed on the first surface of the board and the recess is provided with the bottom face of the recess for screwing or driving the fixing element thereto; and wherein the depth of the recess is set to be in range from 0.1 mm to 2.0 mm.

11. The method as defined in claim 10, wherein a guide plate provided with a guide hole for inserting the male die there into and an abutment face for abutment against the first surface of the board is used, and the pressing face of said male die is pressed against the first surface of the board such that the abutment face is in contact with the first surface of the board.

12. The method as defined in claim 10, wherein a penetrating member which has a profile substantially conforming to an outline of the recess and which transitionally penetrates the first surface of the board for facilitating deformation of the first surface is used.

13. The method as defined in claim 10, wherein the first surface of of the board is colored before forming a recess or through hole in the board in a color matching the bottom face, and after the recess of the predetermined depth is formed, the first surface of the board is colored in a color brighter than the color of the bottom face.

14. The method as defined in claim 10, wherein the method further comprises boring the through-holes through the board.

15. A method of installing the board as defined in claim 1, wherein a sound absorption effect and an acoustic reverberation effect are established with use of first boards which are said boards improved in their sound absorption performance by control of a ratio of the recesses and the through-holes, and second boards which are said boards restricted in their sound absorption performance by control of the ratio of the recesses and the through-holes.

16. The method as defined in claim 15, wherein the recesses and the through-holes have equal dimensions.

* * * * *